US005143213A

United States Patent [19]

Moore et al.

[11] Patent Number: 5,143,213

[45] Date of Patent: Sep. 1, 1992

[54] MULTI-PACK FLIP-TOP CIGARETTE CARTON

[75] Inventors: Pamela D. Moore, Chesterfield; Linwood L. Pitt, Jr., Richmond; Howard W. Vogt, Jr., Providence Forge, all of Va.

[73] Assignee: Philip Morris Incorporated, New York, N.Y.

[21] Appl. No.: 594,325

[22] Filed: Oct. 9, 1990

[51] Int. Cl.[5] ..... B65D 85/10

[52] U.S. Cl. ..... 206/273; 206/268; 229/160.1

[58] Field of Search ..... 206/256-259, 206/265, 266, 268, 271, 273, 804, 815, 624; 229/160.1

[56] References Cited

U.S. PATENT DOCUMENTS

| | | | |
|---|---|---|---|
| 2,320,289 | 5/1943 | Marx | 206/624 |
| 2,367,476 | 1/1945 | Tyrseck | 206/268 |
| 2,396,150 | 3/1946 | Bonville . | |
| 2,473,055 | 6/1949 | Guyer . | |
| 2,771,988 | 11/1956 | Sweeney | 206/815 |
| 2,803,394 | 8/1957 | Ringler | 206/268 |
| 2,922,564 | 1/1960 | Van Rosen | 206/268 |
| 2,950,043 | 8/1960 | Ringler . | |
| 2,951,627 | 9/1960 | Wenzel | 206/624 |
| 2,992,766 | 7/1961 | Guyer . | |
| 3,037,683 | 6/1962 | Sherrill . | |
| 3,079,064 | 2/1963 | Ringler . | |
| 3,708,108 | 1/1973 | Rosenburg, Jr. | 206/268 |
| 3,749,234 | 7/1973 | Gero | 206/273 |
| 3,794,238 | 2/1974 | Egli . | |
| 4,072,263 | 2/1978 | Focke . | |
| 4,180,201 | 12/1979 | Focke . | |
| 4,200,221 | 4/1980 | Focke . | |

FOREIGN PATENT DOCUMENTS

| | | | |
|---|---|---|---|
| 2229996 | 10/1990 | United Kingdom | 229/160.1 |

OTHER PUBLICATIONS

Drawing of an European ten-pack carton blank.
Drawing of an European five-pack carton blank.
Sample of an European ten-pack carton blank.

*Primary Examiner*—Jimmy G. Foster
*Attorney, Agent, or Firm*—Fish & Neave

[57] ABSTRACT

A paperboard blank is provided for a multi-pack flip-top cigarette carton. The carton blank has front, back and side panels, top and bottom flaps, and dust flaps. These sections of the carton blank are separated by score lines in such a manner that the blank can be readily formed by conventional means to form a multi-pack flip-top cigarette carton.

38 Claims, 4 Drawing Sheets

MULTI-PACK FLIP-TOP CIGARETTE CARTON

BACKGROUND OF THE INVENTION

The present invention relates generally to cigarette cartons. More specifically, the present invention relates to a multi-pack carton with a flip-top lid.

In the past, cigarettes have generally been sold in packs containing about 20 cigarettes. These 20-cigarette packs have generally been packaged in cartons containing ten packs vertically arrayed in two rows of five packs. For package manufacturing and aesthetic reasons, it is desirable to package cigarette packs laterally in a flip-top carton. Recently five-pack and ten-pack flip-top cartons have been used. The five-pack cartons hold five packs stacked in a lateral configuration. The ten-pack cartons hold ten packs vertically arrayed in two stacked rows of five packs. The packs are removed from these cartons through a flip-top lid. The five-pack cartons include a bottom finger hole through which the user pushes up the stack of packs.

These earlier multi-pack cartons include innerframes which fold longitudinally up from the bottom edge against the inside face of the carton blank. The innerframes include a plurality of edges and cuts which hang up in conventional feeders. These earlier multi-pack cartons lack bottom dust flaps. The lack of bottom dust flaps detracts from the cartons' appearance. These earlier multi-pack cartons also have overlapping top flaps. These overlapping flaps hang up in conventional feeders.

SUMMARY OF THE INVENTION

In accordance with the invention, a carton blank is provided having front, back and side panels, top and bottom end flaps, and dust flaps. These sections of the carton blank are separated by score lines in such a manner that the blank can be readily formed by conventional folding and wrapping machinery components to form a multi-pack flip-top cigarette carton.

It is an object of the present invention to provide a blank that can be readily formed into a cigarette carton that will hold a plurality of cigarette packs.

It is a further object of the present invention to provide a blank that can be readily formed into a flip-top cigarette carton that will hold a plurality of laterally stacked cigarette packs.

It is a further object of the present invention to provide a blank that can be readily formed into a multi-pack flip-top cigarette carton with a laterally folded innerframe with a minimum of edges and cuts to facilitate forming and packing.

It is a further object of the present invention to provide a blank that can be readily formed into a multi-pack flip-top cigarette carton with a minimum number of overlapping sections to facilitate forming and packing.

These and other objects and advantages of the present invention will be apparent from consideration of the following detailed description and accompanying drawings.

DETAILED DESCRIPTION OF THE INVENTION

Figure 7:
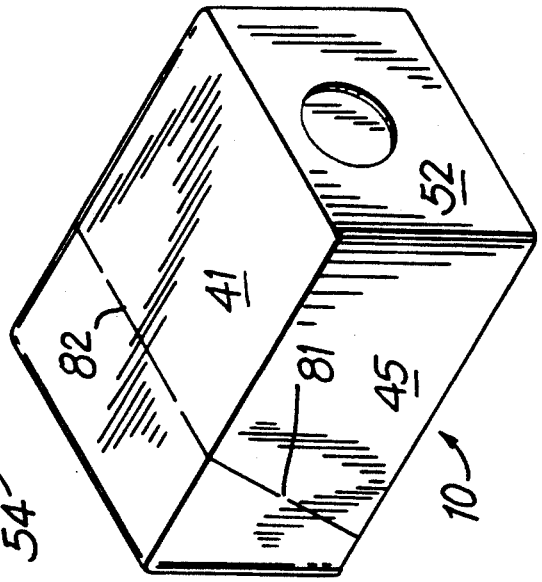
FIG. 7 is perspective view of the carton formed from the blank of the present invention.

A preferred embodiment of the present invention is shown in FIGS. 1–8. Fully erected cigarette carton 10 is shown in FIG. 7. Opposing outside front panel 41 and back panel 43 extend between opposing outside side panel 42 and outside long side flap 45, defining the interior space of carton 10.

Figure 1:
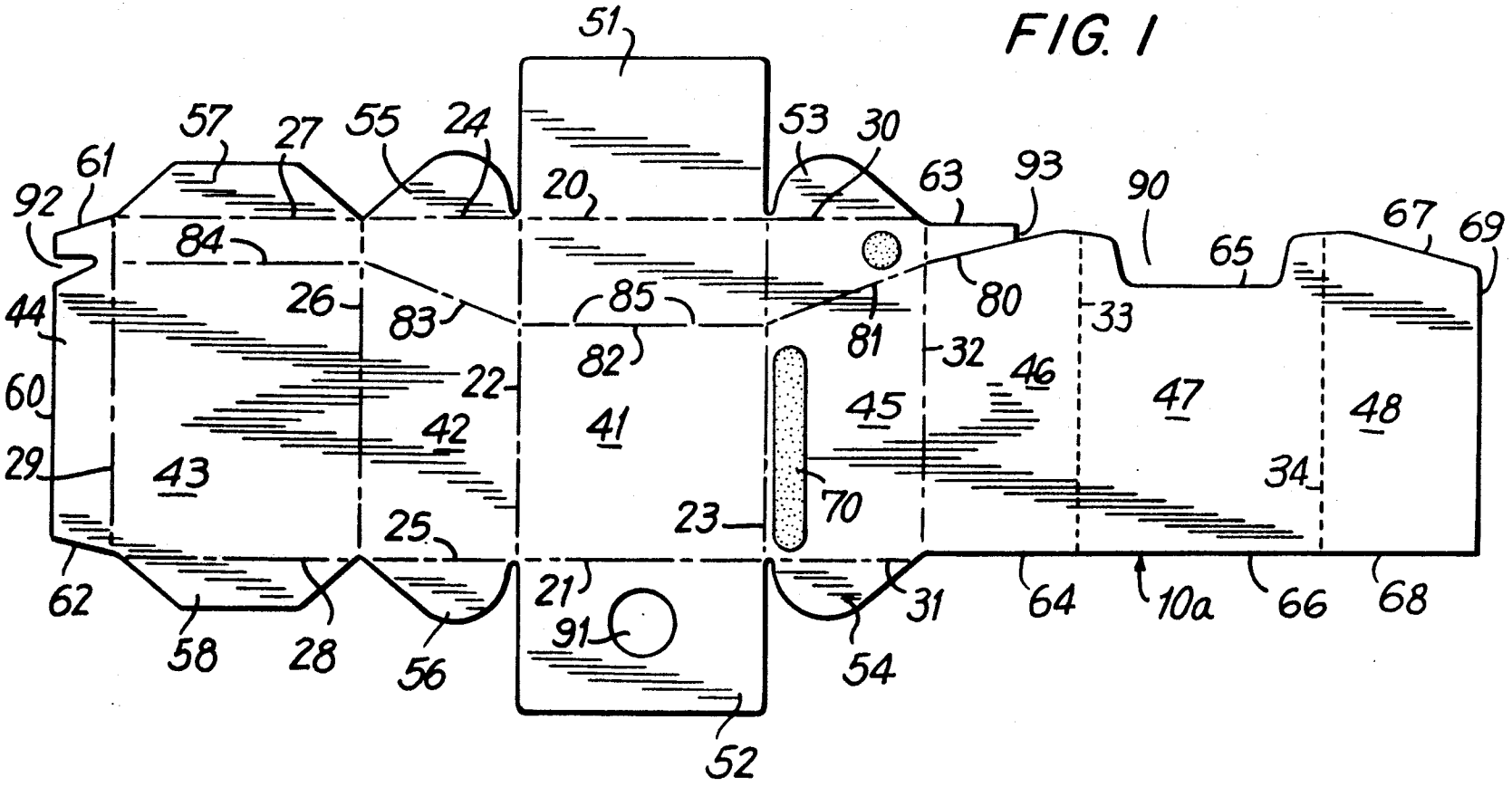
FIG. 1 is a plan view of a preferred embodiment of a carton blank according to this invention in its unerected state.

Cigarette carton 10 is preferably erected from paperboard blank 10*a*, which has eight side sections, and eight top and bottom sections. The eight side sections are: outside and inside front panels 41 and 47, outside and inside side panels 42 and 48, outside and inside long side flaps 45 and 46, back panel 43 and short side flap 44. The eight top and bottom sections are: top and bottom long flaps 51 and 52, top and bottom short flaps 57 and 58, top and bottom leading dust flaps 55 and 56, and top and bottom trailing dust flaps 53 and 54. The preferred embodiment of blank 10*a* is shown in FIG. 1 prior to erection with the printed side down.

Outside front panel 41 is defined in the longitudinal direction by the separation between parallel top score line 20 and bottom score line 21. Outside front panel 41 is defined in the lateral direction by first side score line 22 and second side score line 23 which connect lines 20 and 21. It is preferred that side score lines 22 and 23 be straight lines, parallel to each other and perpendicular to lines 20 and 21.

Outside side panel 42 extends from outside front panel 41 at first side score line 22 to side score line 26, and is further defined by top side score line 24 and bottom side score line 25. It is preferred that line 26 be a straight line, parallel to lines 22 and 23, and perpendicular to lines 24 and 25. The longitudinal dimension of outside side panel 42 is substantially equal to the longitudinal dimension of outside front panel 41, i.e., the distance between lines 22 and 26 is substantially equal to the distance between lines 20 and 21. It is preferred that line 24 be offset below line 20, and line 25 be offset above line 21, by a distance equal to the thickness of paperboard blank 10*a*; these offsets facilitate folding of the end flaps and dust flaps.

Back panel 43 extends from outside side panel 42 at side score line 26 to back score line 29, and is further defined by top back score line 27 and bottom back score line 28. Preferably line 27 is a collinear extension of line 24. Similarly, line 28 is preferably a collinear extension of line 25. It is preferred that line 29 be a straight line, parallel to lines 22, 23 and 26, and perpendicular to lines 27 and 28. It is preferred that the lateral dimension of back panel 43 is substantially equal to the lateral dimension of outside front panel 41, i.e., the distance between lines 26 and 29 is equal to the distance between lines 22 and 23.

Short side flap 44 is connected to back panel 43 along line 29, and is further defined by side short side flap margin 60, top short side flap margin 61 and bottom short side flap margin 62. Preferably, the longitudinal dimension of short side flap 44 is substantially equal to the longitudinal dimension of back panel 43, i.e., the distance between lines 27 and 28. The lateral dimension of short side flap 44 is smaller than the lateral dimension of outside long side flap 45. Short side flap 44 also has a first cutout notch 92 at side short side flap margin 60. It is preferred that the apex of notch 92 intersect back score line 29.

Outside long side flap 45 extends from outside front panel 41 at second side score line 23 to flap score line 32, and is further defined by top flap score line 30 and bottom flap score line 31. It is preferred that line 32 be a straight line, parallel to lines 22, 23, 26 and 29, and perpendicular to lines 30 and 31. It is preferred that the lateral dimension of outside long side flap 45 is smaller than the lateral dimension of outside side panel 42, i.e., the distance between lines 23 and 32 is smaller than the distance between lines 22 and 26. The longitudinal dimension of outside long side flap 45 is substantially equal to the longitudinal dimension of outside front panel 41, i.e., the distance between lines 30 and 31 is substantially equal to the distance between lines 20 and 21. It is preferred that line 30 be offset below line 20, and line 31 be offset above line 21, by a distance equal to the thickness of paperboard blank 10*a;* these offsets facilitate folding of the end flaps and dust flaps.

Inside long side flap 46 extends from outside long side flap 45 at flap score line 32 to inside front score line 33, and is further defined by top inside long side flap margin 63 and bottom inside long side flap margin 64. It is preferred that inside long side flap 46 has a second cutout notch 93 at top inside long side flap margin 63. The longitudinal dimension of inside long side flap 46 from top margin 63 to bottom margin 64 along flap score line 32 may be smaller than or equal to the longitudinal dimension of outside long side flap 45, but preferably is substantially equal to the longitudinal dimension of outside long side flap 45. It is preferred that the lateral dimension of inside long side flap 46 is smaller than the lateral dimension of outside long side flap 45, i.e., the distance between lines 32 and 33 is smaller than the distance between lines 23 and 32. It is preferred that line 33 be a straight line, parallel to lines 22, 23, 26, 29 and 32. Line 33 may be scored or perforated, but it is preferred that line 33 be perforated.

Inside front panel 47 extends from inside long side flap 46 at inside front score line 33 to inside side score line 34, and is further defined by top inside front panel margin 65 and bottom inside front panel margin 66. The inside front panel 47 also has a cutout portion 90 at the top inside front panel margin 65 that forms an opening through which cigarette packs may be withdrawn. The longitudinal dimension of inside front panel 47 is smaller than the longitudinal dimension of outside front panel 41, i.e., the distance between margins 65 and 66 is smaller than the distance between lines 20 and 21. Similarly, the lateral dimension of inside front panel 47 is smaller than the lateral dimension of outside front panel 41, i.e., the distance between lines 33 and 34 is smaller than the distance between lines 22 and 23. It is preferred that inside side score line 34 be a straight line, parallel to lines 22, 23, 26, 29, 32 and 33. Line 34 may be scored or perforated, but it is preferred that line 34 be perforated.

Inside side panel 48 is connected to inside front panel 47 along inside side score line 34, and is further defined by top inside side panel margin 67, bottom inside side panel margin 68 and side inside side panel margin 69. The longitudinal dimension of inside side panel 48 along inside side score line 34 is smaller than the longitudinal dimension of outside side panel 42, i.e., the distance between margins 67 and 68 along line 34 is smaller than the distance between lines 24 and 25. Similarly, the lateral dimension of inside side panel 48 is smaller than the lateral dimension of outside side panel 42, i.e., the distance between line 34 and margin 69 is smaller than the distance between lines 22 and 26. It is preferred that side inside side panel margin 69 be shorter than inside side score line 34.

Top long flap 51 is connected to outside front panel 41 along line 20. The longitudinal dimension of top long flap 51 is substantially equal to the lateral dimension of outside long side flap 45, i.e., the distance between lines 23 and 32. The lateral dimension of top long flap 51 is substantially equal to the lateral dimension of outside front panel 41, i.e., the distance between lines 22 and 23. Similarly, bottom long flap 52 is attached to outside front panel 41 along line 21, and has longitudinal and lateral dimensions substantially equal to the longitudinal and lateral dimensions of top long flap 51, respectively. Bottom long flap 52 preferably has a central cutout finger hole 91. Finger hole 91 permits a user of the erected and packed carton to push up the lateral stack of cigarette packs from the bottom of the carton.

Top short flap 57 is connected to back panel 43 along line 27. Similarly bottom short flap 58 is connected to back panel 43 along line 28. The longitudinal dimension of bottom short flap 58 is small enough that, after the carton 10 is erected, bottom short flap 58 does not block finger hole 91 in bottom long flap 52.

Top leading dust flap 55 is connected to outside side panel 42 along line 24. Similarly, bottom leading dust flap 56 is connected to outside side panel 42 along line 25. Top trailing dust flap 53 is connected to outside long side flap 45 along line 30. Similarly, bottom trailing dust flap 54 is attached to outside long side flap 45 along line 31.

The dimensions of carton blank 10*a*, and the dimensions of the sections comprising carton blank 10*a*, are determined by the number, circumference and length of cigarettes to be packaged in the erected carton 10.

The machine components used in the construction and erection of cigarette cartons from paperboard blanks are well known in the art, and a discussion of the combination of machine components used to construct and erect cartons of the present invention is not necessary to understand the present invention.

Figure 2:
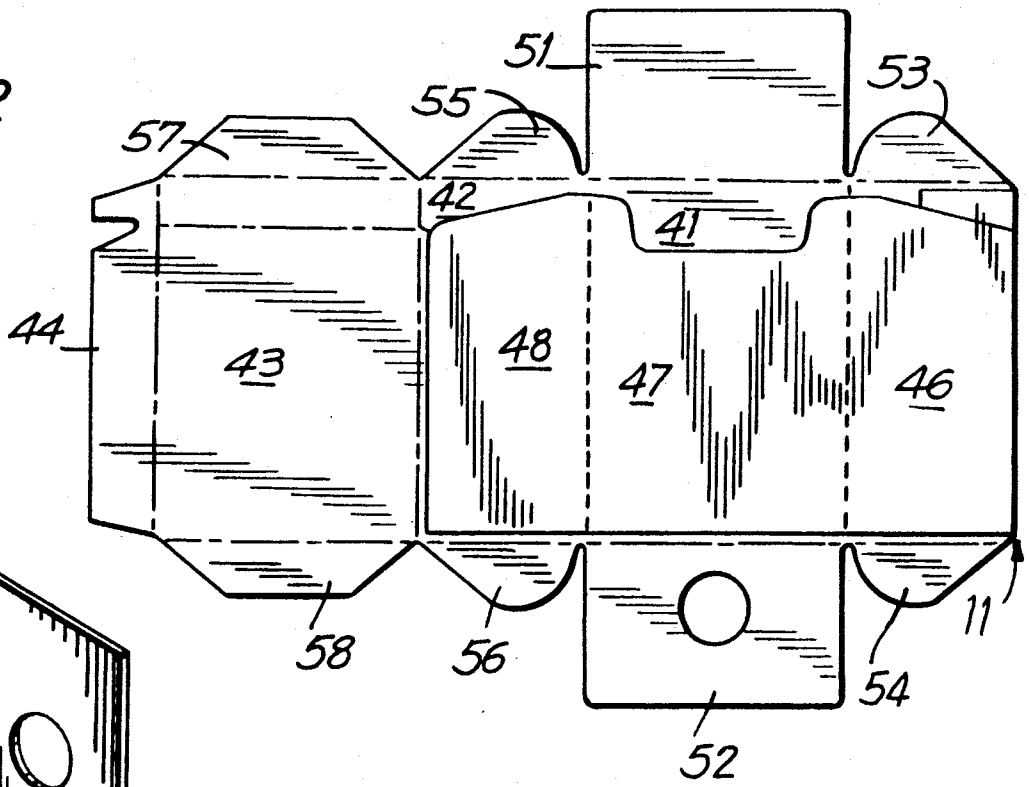
FIG. 2 is a plan view of the carton blank depicted in FIG. 1, with the innerframe folded.
Figure 3:
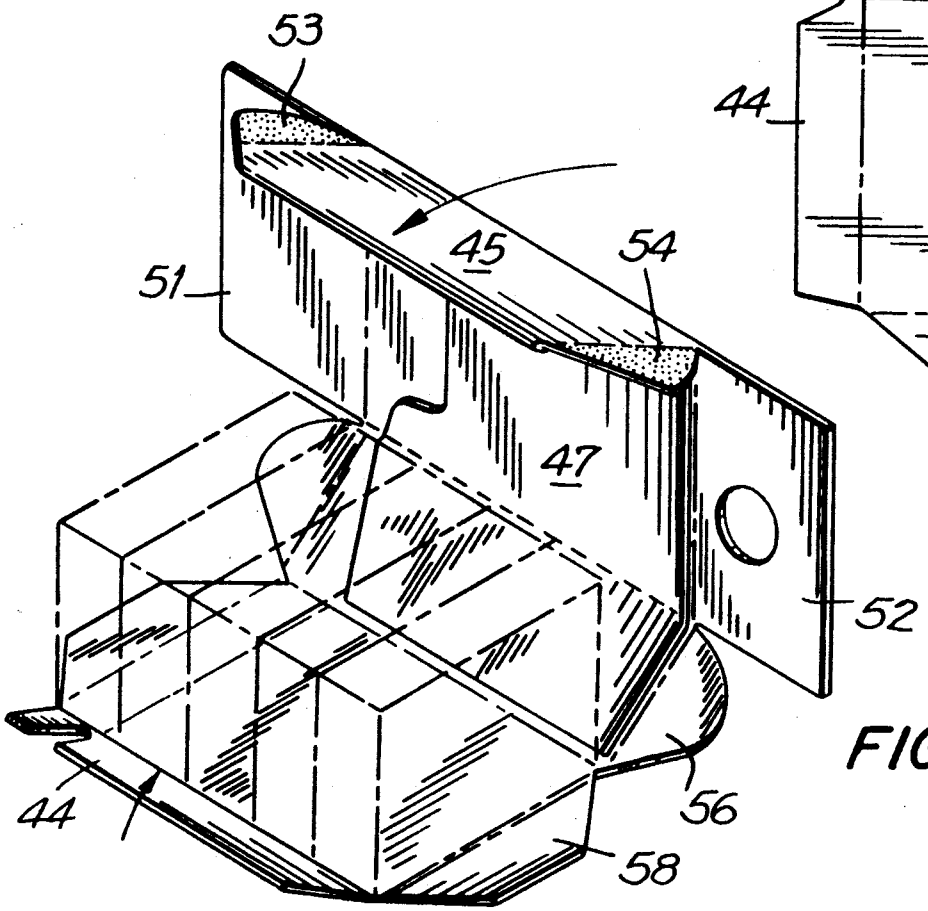
FIG. 3 is a perspective view of the partially erected carton blank depicted in FIG. 1.
Figure 5:
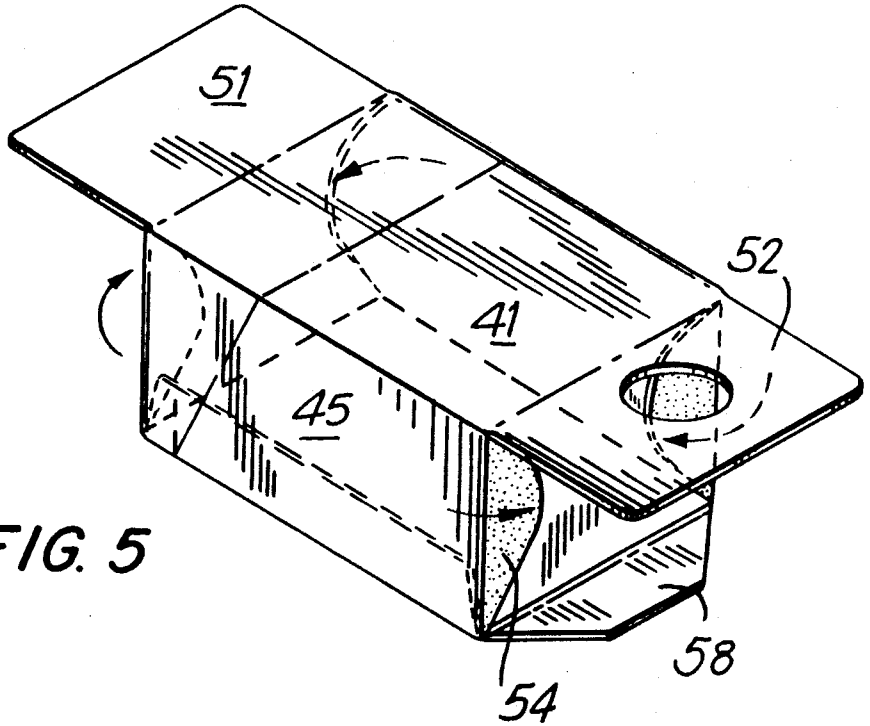
FIG. 5 is aperspective view of the erected carton blank depicted in FIG. 1, with the dust flaps folded.
Figure 4:
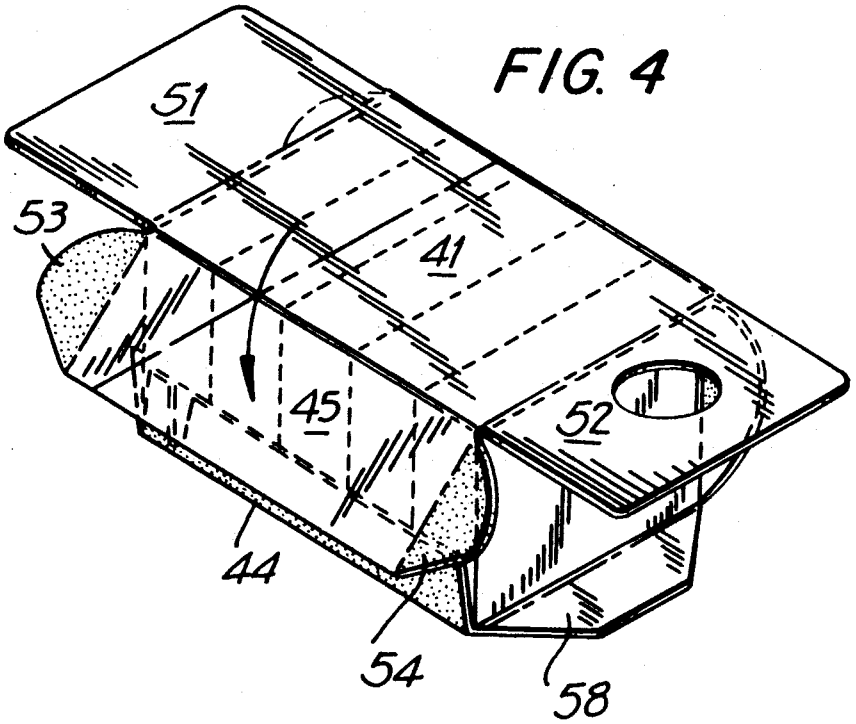
FIG. 4 is a perspective view of the erected carton blank depicted in FIG. 1, with the end flaps and dust flaps unfolded.

The blank 10*a* shown in FIG. 1 is erected to form the carton 10 shown in FIG. 7. As shown in FIG. 2, inner-frame 11, comprised of inside long side flap 46, inside front panel 47 and inside side panel 48, is folded along flap score line 32 so that inside long side flap 46 is contiguous with outside long side flap 45, inside front panel 47 is contiguous with outside front panel 41, and inside side panel 48 is contiguous with outside side panel 42. Inside long side flap 46 is adhesively attached to outside long side flap 45 at glue line 70 and glue dot 71. Preferably, glue line 70 does not intersect cut 81 and is applied close to, but not overlapping, line 23. Similarly, glue dot 71 preferably does not intersect cut 81 and does not extend beyond contiguous inside long side flap 46. As shown in FIG. 3, outside long side flap 45 and inside long side flap 46 are erected perpendicular to outside front panel 41 and inside front panel 47 by folding along second side score line 23 and inside front score line 33. Outside side panel 42 and inside side panel 48 are erected perpendicular to outside front panel 41 and inside front panel 47 by folding along first side score line 22 and inside side score line 34. Back panel 43 is erected perpendicular to outside side panel 42 and inside side panel 48 by folding along side score line 26. Short side flap 44 is erected perpendicular to back panel 43, and parallel to contiguous outside long side flap 45 and inside long side flap 46, by folding along back score line 29. Short side flap 44 is adhesively attached to inside long side flap 46.

Top short flap 57 is erected perpendicular to back panel 43 by folding along top back score line 27. Top leading dust flap 55 is erected perpendicular to outside side panel 42 by folding along top side score line 24. Top trailing dust flap 53 is erected perpendicular to outside long side flap 45 by folding along top flap score line 30. Top long flap 51 is erected perpendicular to outside front panel 41 by folding along top score line 20 and adhesively attached to top short flap 57, top leading dust flap 55 and top trailing dust flap 53. It is preferred that top short flap 57, top leading dust flap 55 and top trailing dust flap 53 not overlap one another when attached to top long flap 51. Further, it is preferred that the top long flap 51 have a greater area than the combined areas of the top short flap 57, top leading dust flap 55 and top trailing dust flap 53.

Bottom short flap 58 is erected perpendicular to back panel 43 by folding along bottom back score line 28. Bottom leading dust flap 56 is erected perpendicular to outside side panel 42 by folding along bottom side score line 25. Bottom trailing dust flap 54 is erected perpendicular to outside long side flap 45 by folding along bottom flap score line 31. Bottom long flap 52 is erected perpendicular to outside front panel 41 by folding along bottom score line 21 and adhesively attached to bottom short flap 58, bottom leading flap 56 and bottom trailing flap 54. It is preferred that bottom short flap 58, bottom leading dust flap 56 and bottom trailing dust flap 54 not overlap one another when attached to bottom long flap 52. Further, it is preferred that the bottom long flap 52 have a greater area than the combined areas of the bottom short flap 58, bottom leading dust flap 56 and bottom trailing dust flap 54.

Figure 8:
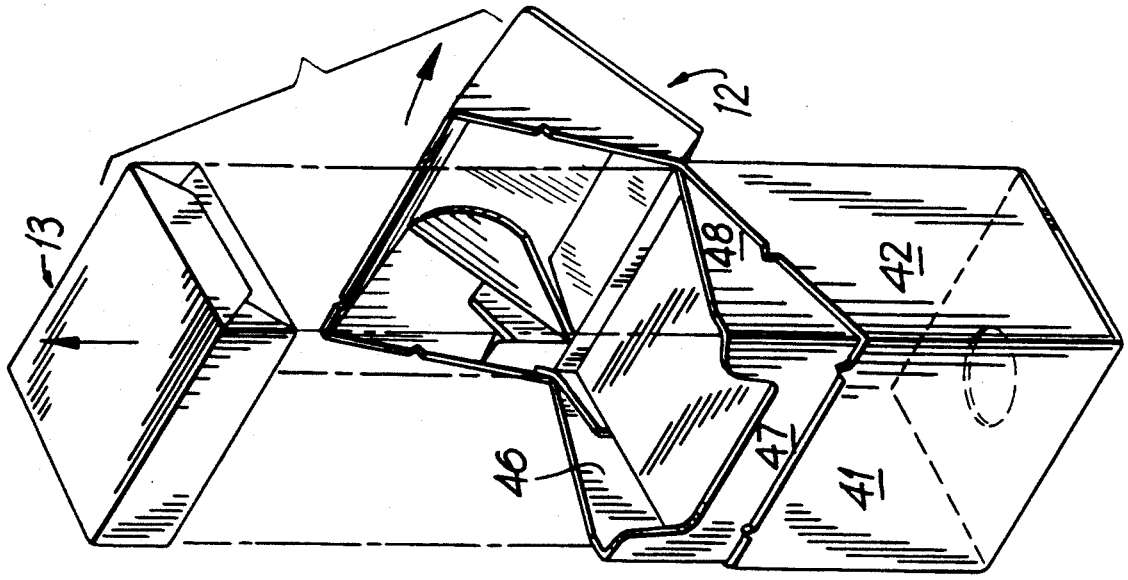
FIG. 8 is a perspective view of a fully erected carton and one of the usual cigarette packs, the carton being shown with the flip-top lid in open condition.
Figure 6:
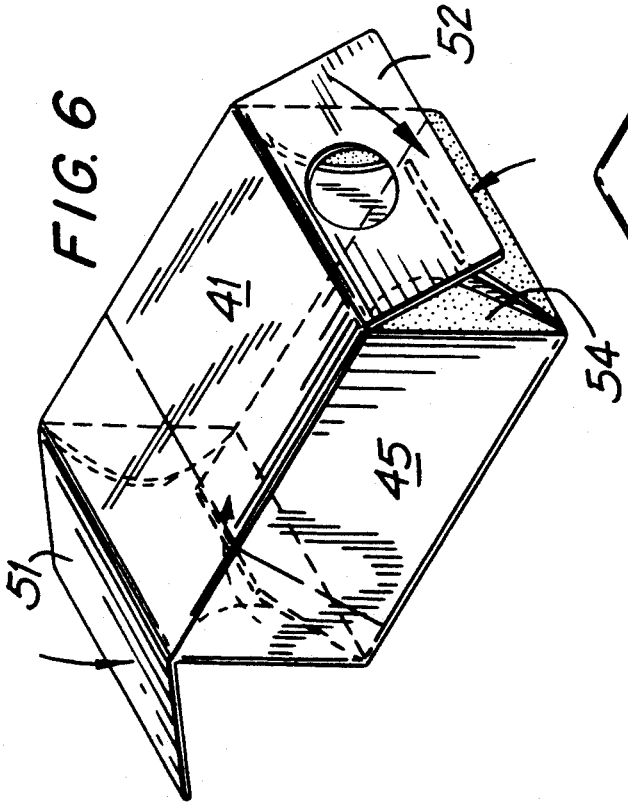
FIG. 6 is a persepctive view of the erected carton blank depicted in FIG. 1, with the end flaps folded.

As shown in FIGS. 1, 7 and 8, the flip-top lid 12 is formed by cut 80 across inside long side flap 46 from top margin 63 to flap score line 32, cut 81 across outside long side panel 45 from the intersection of cut 80 and flap score line 32 to second side score line 23, cut 82 across outside front panel 41 from the intersection of cut 81 and second side score line 23 to first side score line 22, and cut 83 across outside side panel 42 from the intersection of cut 82 and first side score line 22 to side score line 26. Preferably cuts 80, 81, 82 and 83 are straight lines, and cut 82 is parallel to top score line 20. Cuts 80, 81, 82 and 83 are not cut through at a plurality of points 85 to hold the lid closed during forming and packing. Hinge score line 84 extends laterally across back panel 43 from the intersection of cut 83 and side score line 26 to the intersection of back score line 29 and the apex of notch 92. Preferably hinge score line 84 is parallel to top back score line 27.

Having described the invention with particular reference to the preferred embodiment, which is presented for the purpose of illustration and not of limitation, it is apparent that various changes and modification to the preferred embodiment can be made to provide other embodiments also contemplated by the present invention. Accordingly, it is not intended that the invention be limited except by the appended claims.

What is claimed is:

1. A blank for forming a flip-top cigarette carton, the blank comprising:

(a) an outside front panel defined by a top score line, a bottom score line parallel to the top score line, and first and second side score lines transverse of the top and bottom score lines;

(b) an outside side panel connected to the outside front panel at the first side score line, and further defined by a side score line parallel to the first side score line, and top and bottom side score lines transverse of the side score line and the first side score line;

(c) a back panel connected to the outside side panel at the side score line, and further defined by a back score line parallel to the side score line, and top and bottom back score lines transverse of the side score line and back score line;

(d) a short side flap connected to the back panel at the back score line, and further defined by a side short side flap margin parallel to the back score line, and top and bottom short side flap margins transverse of the back score line and the side short side flap margin;

(e) an outside long side flap connected to the outside front panel at the second side score line, and further defined by a flap score line parallel to the second side score line, and top and bottom flap score lines transverse of the second score line and the flap score line;

(f) an innerframe connected to the outside long side flap at the flap score line;

(g) a top long flap connected to the outside front panel at the top score line;

(h) a bottom long flap connected to the outside front panel at the bottom score line;

(i) a top short flap connected to the back panel at the top back score line;

(j) a bottom short flap connected to the back panel at the bottom back score line;

(k) a bottom trailing dust flap connected to the outside long side flap at the bottom flap score line;

(l) a bottom leading dust flap connected to the outside side flap at the top side score line; and (m) the bottom long flap having a greater area than the combined areas of the bottom short flap, the bottom trailing dust flap and the bottom leading dust flap.

2. The blank of claim 1 wherein the flap score line is folded to erect the innerframe adjacent to the outside long side flap, the outside front panel and the outside side panel.

3. The blank of claim 1 further comprising a plurality of bottom dust flaps.

4. The blank of claim 3 further comprising a plurality of top dust flaps.

5. The blank of claim 4 wherein the top short flap and the plurality of top dust flaps do not overlap one another when the blank is fully erected to form a carton.

6. The blank of claim 5 wherein the bottom short flap and the plurality of bottom dust flaps do not overlap one another when the blank is fully erected to form a carton.

7. A flip-top cigarette carton, the cigarette carton comprising:

(a) an outside front panel defined by a top score line, a bottom score line parallel to the top score line, and first and second side score lines transverse of the top and bottom score lines;

(b) an outside side panel connected to the outside front panel at the first side score line, and further defined by a side score line parallel to the first side score line, and top and bottom side score lines transverse of the side score line and the first side score ling;

(c) a back panel connected to the outside side panel at the side score line, and further defined by a back score line parallel to the side score line, and top and bottom back score lines transverse of the side score line and back score line;

(d) a short side flap connected to the back panel at the back score line, and further defined by a side short side flap margin parallel to the back score line, and top and bottom short side flap margins transverse of the back score line and the side short side flap margin;

(e) an outside long side flap connected to the outside front panel at the second side score line, and further defined by a flap score line parallel to the second side score line, and top and bottom flap score lines transverse of the second score line and the flap score line;

(f) an innerframe connected to the outside long side flap at the flap score line;

(g) a top long flap connected to the outside front panel at the top score line;

(h) a bottom long flap connected to the outside front panel at the bottom score line;

(i) a top short flap connected to the back panel at the top back score line;

(j) a bottom short flap connected to the back panel at the bottom back score line;

(k) a bottom trailing dust flap connected to the outside long side flap at the bottom flap score line;

(l) a bottom leading dust flap connected to the outside side flap at the top side score line; and (m) the bottom long flap having a greater area than the combined areas of the bottom short flap, the bottom trailing dust flap and the bottom leading dust flap.

8. The cigarette carton of claim 7 wherein the flap score line is folded to erect the innerframe adjacent to the outside long side flap, the outside front panel and the outside side panel.

9. The cigarette carton of claim 7 further comprising a plurality of bottom dust flaps.

10. The cigarette carton of claim 9 further comprising a plurality of top dust flaps.

11. The cigarette carton of claim 10 wherein the top short flap and the plurality of top dust flaps do not overlap one another when the blank is fully erected to form a carton.

12. The cigarette carton of claim 11 wherein the bottom short flap and the plurality of bottom dust flaps do not overlap one another when the blank is fully erected to form a carton.

13. A blank for forming a cigarette carton, the blank comprising:

(a) an outside front panel defined by a top score line, a bottom score line parallel to the top score line, and first and second side score lines transverse of the top and bottom score lines;

(b) an outside side panel connected to the outside front panel at he first side score line, and further defined by a side score line parallel to the first side score line, and top and bottom side score lines transverse of the side score line and the first side score line;

(c) a back panel connected to the outside side panel at the side score line, and further defined by a back score line parallel to the side score line, and top and bottom back score lines transverse of the side score line and back score line;

(d) a short side flap connected to the back panel at the back score line, and further defined by a side short side flap margin parallel to the back score line, and top and bottom short side flap margins transverse of the back score line and the side short side flap margin;

(e) an outside long side flap connected to the outside front panel at the second side score line, and further defined by a flap score line parallel to the second side score line, and top and bottom flap score lines transverse of the second score line and the flap score line;

(f) an inside long side flap connected to the outside long side flap at the flap score line, and further defined by an inside front score line parallel to the flap score line, and top and bottom inside long side flap margins transverse of the flap score line and the inside front score line;

(g) an inside front panel connected to the inside long side flap at the inside front score line, and further defined by an inside side score line parallel to the inside front score line, and top and bottom inside front panel margins transverse of the inside front score line and the inside side score line;

(h) an inside side panel connected to the inside front panel at the inside side score line, and further defined by a side inside side panel margin parallel to the inside side score line, and top and bottom inside side panel margins transverse of the inside side score line and the side inside side panel margin;

(i) a top long flap connected to the outside front panel at the top score line;

(j) a bottom long flap connected to the outside front panel at the bottom score line;

(k) a top trailing dust flap connected to the outside long side flap at the top flap score line;

(l) a bottom trailing dust flap connected to the outside long side flap at the bottom flap score line;

(m) a top leading dust flap connected to the outside side panel at the top side score line;

(n) a bottom leading dust flap connected to the outside side panel at the bottom side score line;

(o) a top short flap connected to the back panel at the top back score line;

(p) a bottom short flap connected to the back panel at the bottom back score line; and (g) the top long flap having a greater area than the combined areas of the top short flap, the top leading dust flap, and the top trailing dust flap.

14. The blank of claim 13 wherein the inside side score line and the inside front score line are perforated.

15. The blank of claim 14 wherein the bottom has a centrally oriented cutout hole.

16. The blank of claim 15 wherein the outside flap, the outside front panel, the side panel and the inside long side flap are cut to form a flip-top lid.

17. The blank of claim 16 wherein the back panel has a hinge score line parallel to the top back score line, and transverse of the side score line and the back score line.

18. The blank of claim 17 wherein the inside front panel has a cutout portion at the top inside front panel margin.

19. The blank of claim 18 wherein the short side flap has a first cutout notch at the side short side flap margin.

20. The blank of claim 19 wherein the inside long side flap has a second cutout notch at the top inside long side flap margin.

21. The blank of claim 13 wherein the flap score line is folded to erect the inside long side flap, the inside front panel and the inside side panel adjacent to the outside long side flap, the outside front panel and the outside side panel, respectively, the second side score line and the inside front score line are folded to erect the outside long side flap and the inside long side flap perpendicular to the outside front panel and the inside front panel, the first side score line and the inside side score line are folded to erect the outside side panel and the inside side panel perpendicular to the outside front panel and the inside front panel, the side score line is folded to erect the back panel perpendicular to the outside side panel and the inside side panel, the back score line is folded to erect the short side flap perpendicular to the back panel, the top back score line is folded to erect the top short flap perpendicular to the back panel, the top side score line is folded to erect the top leading dust flap perpendicular to the outside side panel, the top flap score line is folded to erect the top trailing dust flap perpendicular to the outside long side flap, the top score line is folded to erect the top long flap perpendicular to the outside front panel, the bottom back score line is folded to erect the bottom short flap perpendicular to the back panel, the bottom side score line is folded to erect the bottom leading dust flap perpendicular to the outside side panel, the bottom flap score line is folded to erect the bottom trailing dust flap perpendicular to the outside long side flap, and the bottom score line is folded to erect the bottom long flap perpendicular to the outside front panel.

22. The blank of claim 21 wherein the top short flap, the top leading dust flap and the top trailing dust flap do not overlap one another.

23. The blank of claim 22 wherein the bottom the bottom leading dust flap and the bottom trailing dust flap do not overlap one another.

24. The blank of claim 23 wherein the bottom long flap has a centrally oriented cutout hole.

25. The blank of claim 24 wherein the bottom short flap, the bottom leading dust flap and the bottom trailing dust flap do not overlap the cutout hole in the bottom long flap.

26. A cigarette carton, the cigarette carton comprising:

(a) an outside front panel defined by a top score line, a bottom score line parallel to the top score line, and first and second side score lines transverse of the top and bottom score lines;

(b) an outside side panel connected to the outside front panel at the first side score line, and further defined by a side score line parallel to the first side score line, and top and bottom side score lines transverse of the side score line and the first side score line;

(c) a back panel connected to the outside side panel at the side score line, and further defined by a back score line parallel to the side score line, and top and bottom back score lines transverse of the side score line and back score line;

(d) a short side flap connected to the back panel at the back score line, and further defined by a side short side flap margin parallel to the back score line, and top and bottom short side flap margins transverse of the back score line and the side short side flap margin;

(e) an outside long side flap connected to the outside front panel at the second side score line, and further defined by a flap score line parallel to the second side score line, and top and bottom flap score lines transverse of the second score line and the flap score line;

(f) an inside long side flap connected to the outside long side flap at the flap score line, and further defined by an inside front score line parallel to the flap score line, and top and bottom inside long side flap margins transverse of the flap score line and the inside front score line;

(g) an inside front panel connected to the inside long side flap at the inside front score line, and further defined by an inside side score line parallel to the inside front score line, and top and bottom inside front panel margins transverse of the inside front score line and the inside side score line;

(h) an inside side panel connected to the inside front panel at the inside side score line, and further defined by a side inside side panel margin parallel to the inside side score line, and top and bottom inside side panel margins transverse of the inside side score line and the side inside side panel margin;

(i) a top long flap connected to the outside front panel at the top score line;

(j) a bottom long flap connected to the outside front panel at the bottom score line;

(k) a top trailing dust flap connected to the outside long side flap at the top flap score line;

(l) a bottom trailing dust flap connected to the outside long side flap at the bottom flap score line;

(m) a top leading dust flap connected to the outside side panel at the top side score line;

(n) a bottom leading dust flap connected to the outside side panel at the bottom side score line;

(o) a top short flap connected to the back panel at the top back score line;

(p) a bottom short flap connected to the back panel at the bottom back score line; and (g) the top long flap having a greater area than the combined areas of the top short flap, the top leading dust flap, and the top trailing dust flap.

27. The cigarette carton of claim 26 wherein the inside side score line and the inside front score line are perforated.

28. The cigarette carton of claim 27 wherein the bottom long flap has a centrally oriented cutout hole.

29. The cigarette carton of claim 28 wherein the outside long side flap, the outside front panel, the outside side panel and the inside long side flap are cut to form a flip-top lid.

30. The cigarette carton of claim 29 wherein the back panel has a hinge score line parallel to the top back score line, and transverse of the side score line and the back score line.

31. The cigarette carton of claim 30 wherein the inside front panel has a cutout portion at the top inside front panel margin.

32. The cigarette carton of claim 31 wherein the short side flap has a first cutout notch at the side short side flap margin.

33. The cigarette carton of claim 32 wherein the inside long side flap has a second cutout notch at the top inside long side flap margin.

34. The cigarette carton of claim 26 wherein the flap score line is folded to erect the inside long side flap, the inside front panel and the inside side panel adjacent to the outside long side flap, the outside front panel and the outside side panel, respectively, the second side score line and the inside front score line are folded to erect the outside long side flap and the inside long side flap perpendicular to the outside front panel and the inside front panel, the first side score line and the inside side score line are folded to erect the outside side panel and the inside side panel perpendicular to the outside front panel and the inside front panel, the side score line is folded to erect the back panel perpendicular to the outside side panel and the inside side panel, the back score line is folded to erect the short side flap perpendicular to the back panel, the top back score line is folded to erect the top short flap perpendicular to the back panel, the top side score line is folded to erect the top leading dust flap perpendicular to the outside side panel, the top flap score line is folded to erect the top trailing dust flap perpendicular to the outside long side flap, the top score line is folded to erect the top long flap perpendicular to the outside front panel, the bottom back score line is folded to erect the bottom short flap perpendicular to the back panel, the bottom side score line is folded to erect the bottom leading dust flap perpendicular to the outside side panel, the bottom flap score line is folded to erect the bottom trailing dust flap perpendicular to the outside long side flap, and the bottom score line is folded to erect the bottom long flap perpendicular to the outside front panel.

35. The cigarette carton of claim 34 wherein the top short flap, the top leading dust flap and the top trailing dust flap do not overlap one another.

36. The cigarette carton of claim 35 wherein the bottom short flap, the bottom leading dust flap and the bottom trailing dust flap do not overlap one another.

37. The cigarette carton of claim 36 wherein the bottom long flap has a centrally oriented cutout hole.

38. The cigarette carton of claim 37 wherein the bottom short flap, the bottom leading dust flap and the bottom trailing dust flap do not overlap the cutout hole in the bottom long flap.

* * * * *